US006234828B1

(12) United States Patent
Kuo

(10) Patent No.: US 6,234,828 B1
(45) Date of Patent: May 22, 2001

(54) ELECTRICAL CONNECTOR ASSEMBLY WITH IMPROVED LOCKING MEANS

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,374

(22) Filed: Dec. 29, 1999

(30) Foreign Application Priority Data

Dec. 7, 1999 (TW) ..... 88220828

(51) Int. Cl.[7] ..... H01R 13/627
(52) U.S. Cl. ..... 439/358
(58) Field of Search ..... 439/350–358, 439/607, 609, 610

(56) References Cited

U.S. PATENT DOCUMENTS 5,727,970 * 3/1998 Koguchi et al. ..... 439/358
5,775,931 * 7/1998 Jones ..... 439/358
5,788,528 * 8/1998 Orr, Jr. et al. ..... 439/358
6,056,578 * 5/2000 Lin ..... 439/358

* cited by examiner

*Primary Examiner*—Gary F. Paumen
(74) *Attorney, Agent, or Firm*—Wei Te Chung

(57) ABSTRACT

An electrical connector assembly includes first and second electrical connectors which mate to each other. The first connector includes a first insulative housing, a number of first contacts received in the first housing and a grounding shroud enclosing a first mating portion of the first housing. The grounding shroud defines two openings. The second electrical connector includes a second insulative housing, a number of second contacts received in the second housing and two latches respectively positioned in the second housing. Each latch has an engaging portion comprising two tabs laterally extending from side edges thereof, respectively. When the first and the second connectors are fully mated together, the tabs of the two latches are engageably received in the two openings of the grounding shroud, respectively, thereby joining the first and the second electrical connectors together.

1 Claim, 4 Drawing Sheets

ELECTRICAL CONNECTOR ASSEMBLY WITH IMPROVED LOCKING MEANS

BACKGROUNDING SHROUD OF THE INVENTION

1. Field of the Invention

The present invention relates to a connector assembly, and particularly to a connector assembly with improved locking means.

2. Description of the Prior Art

Referring to FIG. 1, a conventional electrical connector assembly disclosed in Taiwan Patent Application No. 84201383 comprises a first electrical connector 80 and a second electrical connector 91 adapted for being mated together. The first connector 80 comprises a pair of locking means 81 deflectably positioned in opposite sides thereof. The second connector 91 defines a pair of openings 92 complementary to the pair of locking means 81. When the first and the second connectors 80, 91 are mated together, the pair of locking means 81 are interferentially received in the pair of openings 92, respectively, thereby preventing a disengagement of the first connector 80 from the second connector 91. However, the presence of the two openings 92 enlarges the second connector 91 and makes the manufacture of the second connector 91 more difficult, thereby increasing its cost. Hence, an improved electrical connector assembly is required.

BRIEF SUMMARY OF THE INVENTION

An object of the present invention is to provide an electrical connector assembly with a locking means that can be manufactured at a low cost.

To fulfil the above object, an electrical connector assembly comprises first and second electrical connectors which mate to each other. The first connector includes a first insulative housing, a plurality of first contacts received in the first housing and a grounding shroud enclosing a first mating portion of the first housing. The grounding shroud defines two openings. The second electrical connector includes a second insulative housing, a plurality of second contacts received in the second housing and two latches respectively positioned inside the second housing. Each latch has an engaging portion comprising two tabs laterally extending from side edges thereof, respectively. When the first and the second connectors are fully mated together, the tabs of the two latches are engageably received in the two openings of the grounding shroud, respectively, thereby joining the first and the second electrical connectors together.

Other objects, advantages and novel features of the invention will become more apparent from the following detailed description of the present embodiment when taken in conjunction with the accompanying drawings.

DETAILED DESCRIPTION OF THE INVENTION

Figure 1:
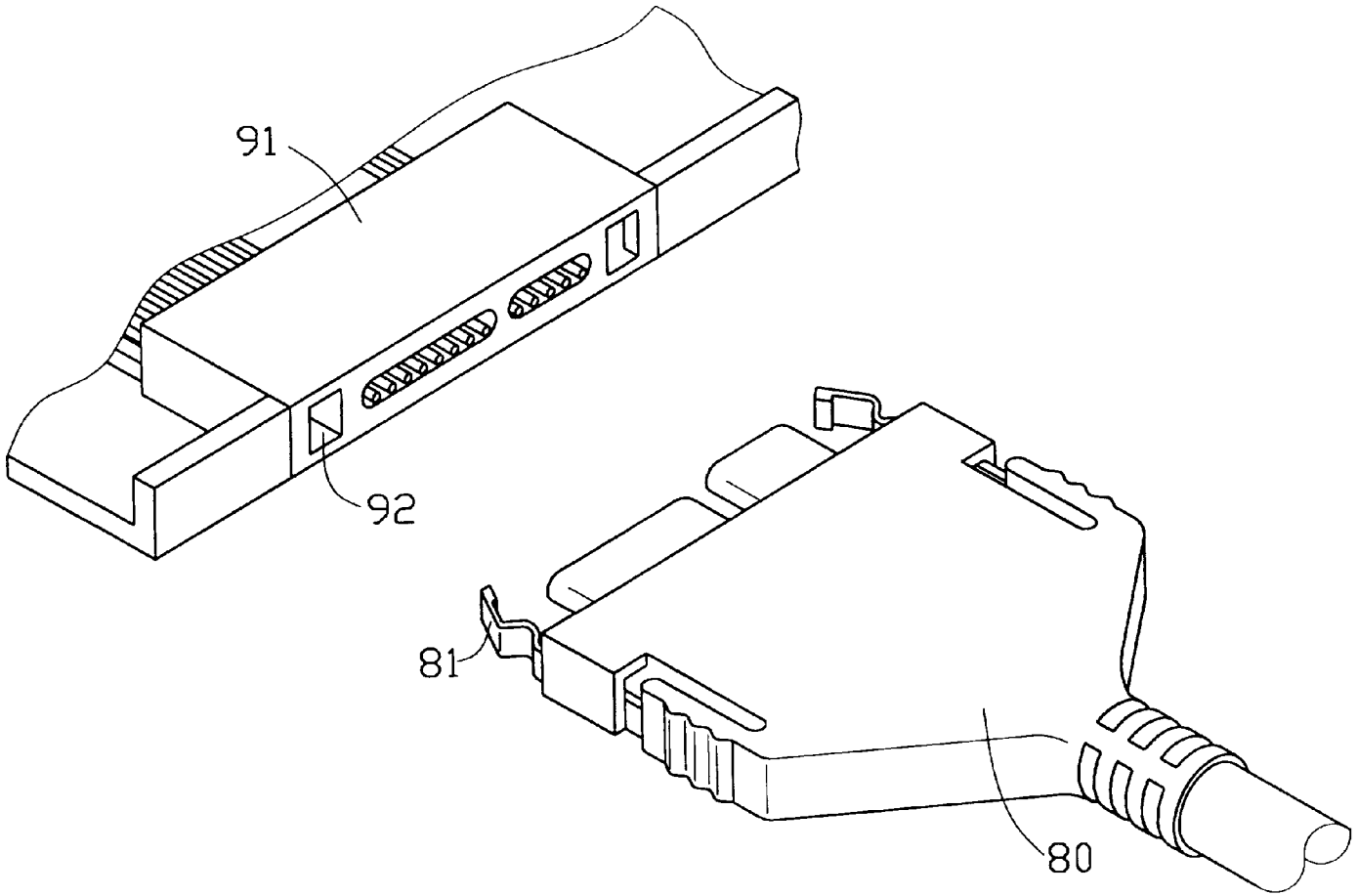
FIG. 1 (PRIOR ART)
FIG. 1 is a perspective view of a conventional electrical connector assembly showing two conventional connectors before mating together.
Figure 2:
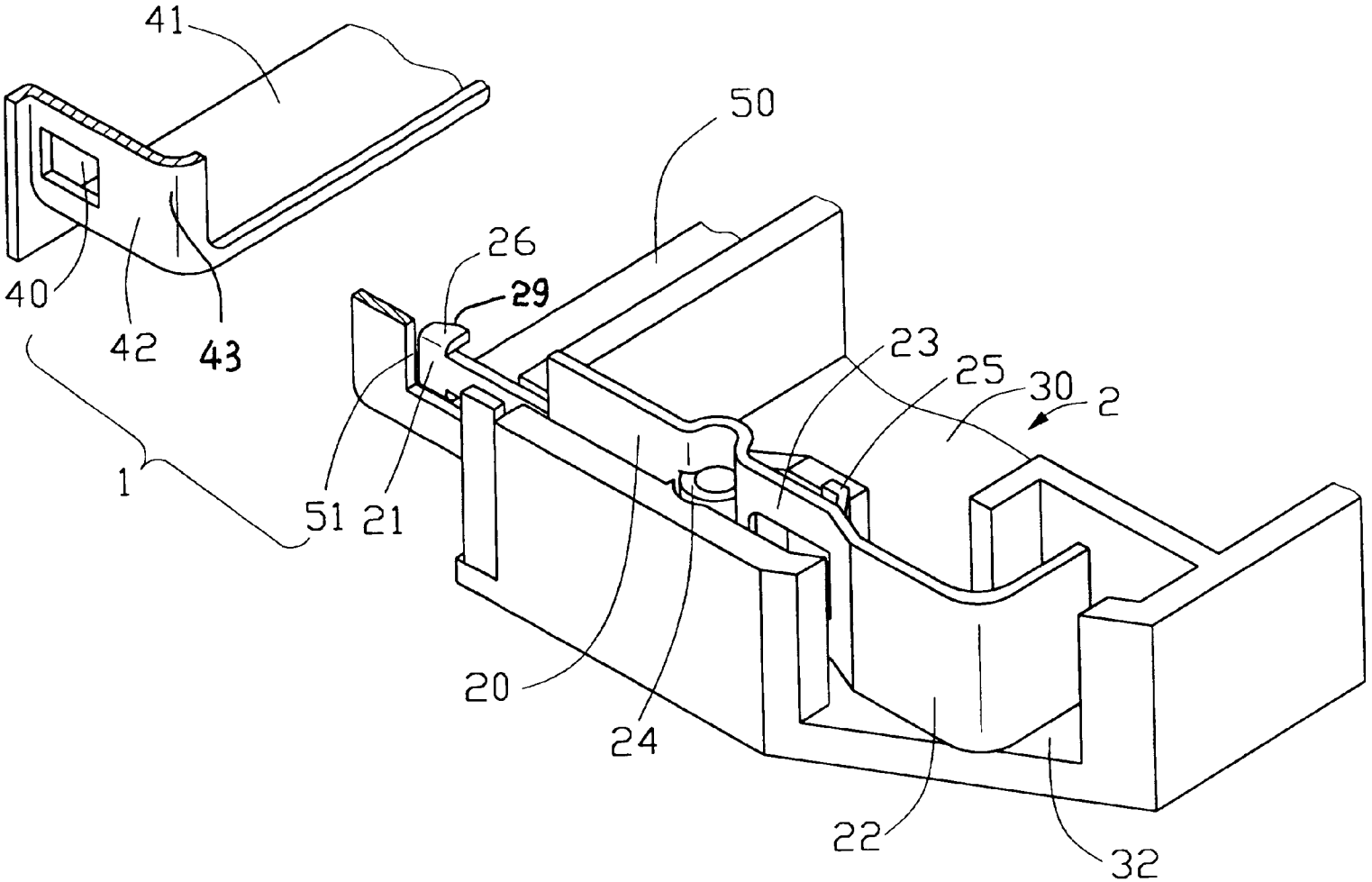
FIG. 2 is a partial perspective view of an electrical connector assembly of the present invention partially showing two connectors before mating together.

Referring to FIG. 2, an electrical connector assembly 1 of the present invention comprises a first electrical connector and a second electrical connector adapted for mating to each other. The first connector comprises a first insulative housing (not shown), a plurality of contacts (not shown) received in the first housing and a grounding shroud 41 enclosing a first mating portion of the first housing. The first housing and the first contacts are conventional, therefore detailed description of the constructions thereof are omitted here for conciseness. The grounding shroud 41 defines two openings 40 (only one opening is shown) in opposite side walls 42 thereof.

The second connector 2 comprises a second insulative housing 30, a plurality of second contacts (not shown) received in the second housing 30, a shell 50 partially enclosing a mating portion of the second housing 30 and a pair of latches 20 pivotably positioned in opposite sides of the second housing 30. Each latch 20 comprises an engaging portion 21, a press portion 22 and a retention portion 23 between the engaging portion 21 and the press portion 22. The retention portion 23 is pivotably positioned in a channel (not labeled) of the second housing 30 and the engaging portion 21 and the press portion 22 respectively extend beyond a mating face and a side face of the housing 30. The retention portion 23 forms a pivot portion 24 and a spring arm 25 by which the latch 20 is biased to pivot around the pivot portion 24. The engaging portion 21 forms a pair of tabs 26 laterally extending from opposite side edges thereof. The shell 50 defines two slots 51 adjacent to the engaging portions 21 of the two latches 20 which allow the engaging portions 21 to be freely movable outwardly.

Figure 3:
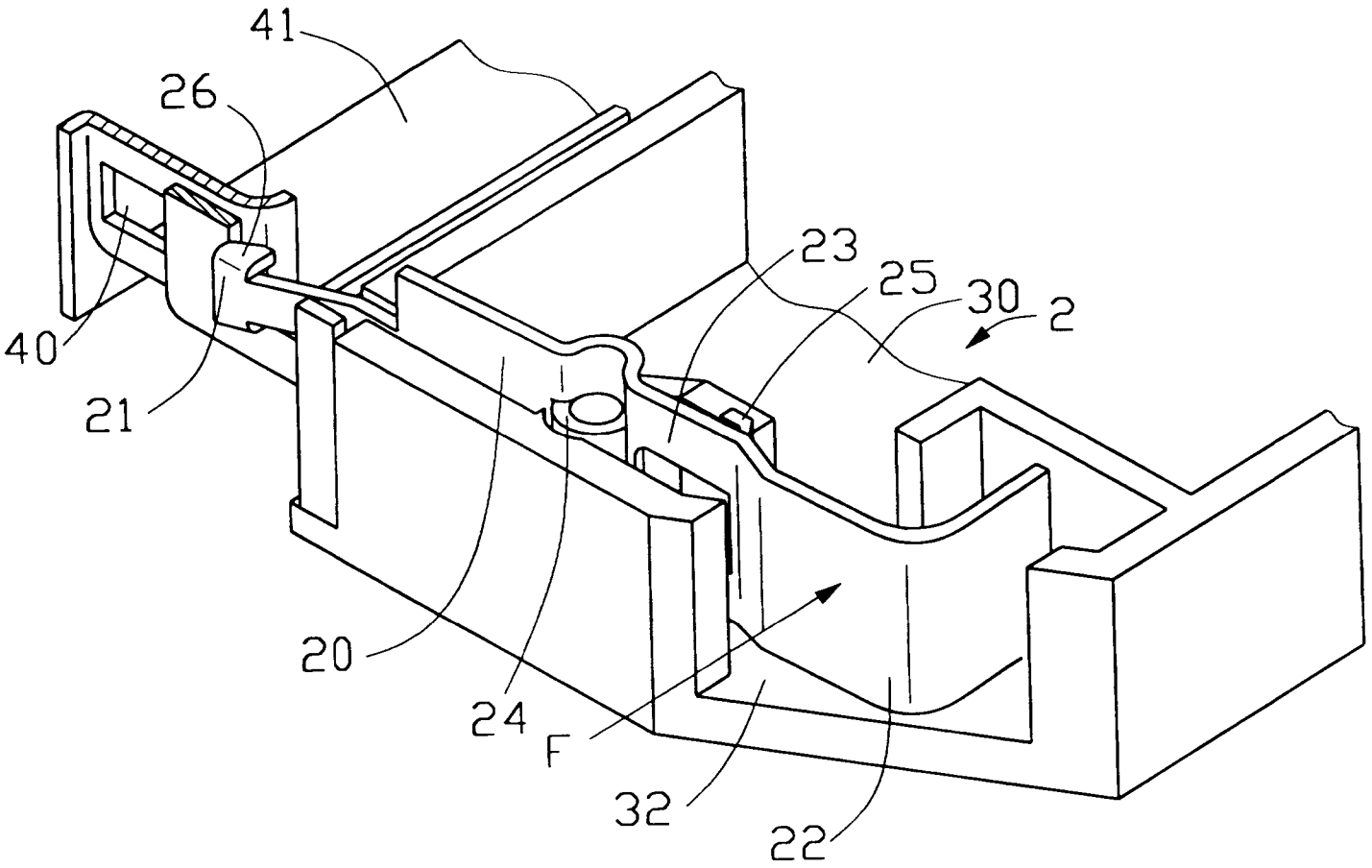
FIGS. 3 and 4 are views similar to FIG. 2 sequentially illustrating the mating process between the first and the second connectors.
Figure 4:
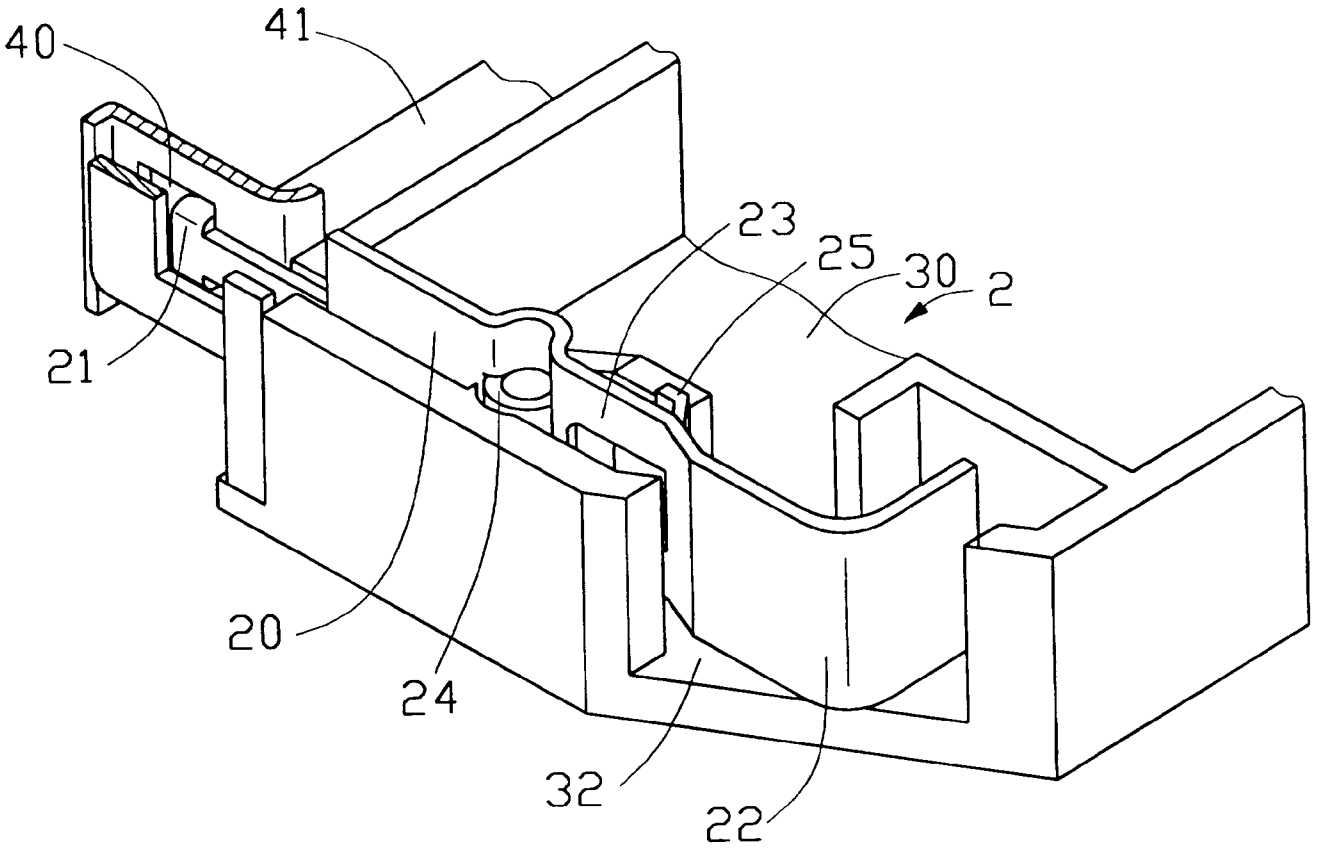

Also referring to FIGS. 3 and 4, when the second connector 2 is mating to the first connector, a force F is exerted on the press portion 22 of each latch 20 to actuate the press portion 22 to move inwardly, which results in an outward movement of the engaging portion 21 through the slot 51 of the shell 50. Thus, the first and the second connectors are mated together without interference between the engaging portions 21 of the latches 20 and the grounding shroud 41 of the first connector. When the first and the second connectors are fully mated together, the force F is removed from the press portions 22, which results in the engaging portions 21 moving inwardly because of the function of the spring arm 25, whereby the two tabs 26 of each engaging portion 21 are received in the corresponding opening 40 of the grounding shroud 41. Therefore, the two latches 20 engage with the grounding shroud 41 to prevent disengagement of the first and the second connectors.

It is noted that the tab 28 of the engaging portion 21 defines a tapered section 29 on its front edge, and grounding shroud 41 defines a round corner 43 on the side wall 42 for facilitating engagement between the engaging portion 21 and the opening 40 of the side wall 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first electrical connector including a first insulative housing, a plurality of first contacts received in the first housing, and a grounding shroud enclosing a first mating portion of the first housing; and a second electrical connector including a second insulative housing, a plurality of second contacts received in the second housing and two latches partially positioned inside the second housing, respectively, the two latches being pivotable with respect to the second housing to engageably hook the grounding shroud of the first electrical connector, thereby joining the first and the second electrical connectors together;

wherein the grounding shroud defines two openings and each latch comprises an engaging portion extending beyond a mating face of the second housing, the engaging portion being partially received in a respective one of the two openings;

wherein the engaging portion of each latch has at least one tab laterally extending from a side edge thereof;

wherein a shell encloses a mating portion of the second housing which defines two slots through which engaging portions of the two latches are allowed to deflect, aiding smooth engagement of the two latches with the openings in the grounding shroud of the first electrical connector.

* * * * *